US005114317A

United States Patent [19]

Cohen

[11] Patent Number: 5,114,317

[45] Date of Patent: May 19, 1992

[54] LOW WEIGHT FAN WITH INTERNAL COOLING

[75] Inventor: Mordechai Cohen, San Diego, Calif.

[73] Assignee: Sundstrand Corporation, Rockford, Ill.

[21] Appl. No.: 424,949

[22] Filed: Oct. 23, 1989

[51] Int. Cl.[5] ..... F04B 35/04

[52] U.S. Cl. ..... 417/354; 417/366; 417/423.15; 417/423.12; 310/62; 415/182.1

[58] Field of Search ..... 417/353, 366, 423.8, 417/423.14, 368, 369, 423.15, 423.12, 371, 423.1, 423.2, 423.7; 310/62; 415/182.1, 175, 176, 177, 211.2, 146; 416/204 R

[56] References Cited

U.S. PATENT DOCUMENTS

| | | | |
|---|---|---|---|
| 975,532 | 11/1910 | Keller | 417/366 |
| 1,645,064 | 10/1927 | Lewinnek | 310/62 |
| 1,665,459 | 4/1928 | Hollander et al. | 415/175 |
| 1,932,231 | 10/1933 | Schmidt | 417/369 |
| 2,321,126 | 6/1943 | Breuer . | |
| 2,397,171 | 12/1943 | Troller et al. | 415/211.2 |
| 2,641,987 | 6/1953 | Burgan | 98/116 |
| 2,661,146 | 12/1953 | Hill et al. | 417/423.1 |
| 2,782,982 | 2/1957 | Merz | 417/423.15 |
| 2,950,859 | 8/1960 | Kirk | 417/353 |
| 2,968,249 | 1/1961 | Caine et al. . | |
| 2,969,908 | 1/1961 | Dallenbach . | |
| 3,089,637 | 5/1963 | Bell . | |
| 3,263,906 | 8/1966 | Ward | 415/146 |
| 3,341,113 | 9/1967 | Sebok et al. . | |
| 3,643,119 | 2/1972 | Lukens | 310/60 |
| 3,936,423 | 2/1976 | Gakenholz | 417/366 |
| 4,213,745 | 7/1980 | Roberts | 417/363 |
| 4,464,580 | 8/1984 | Miller et al. | 415/175 |

FOREIGN PATENT DOCUMENTS

| | | | |
|---|---|---|---|
| 733544 | 7/1955 | United Kingdom | 417/366 |

*Primary Examiner*—Leonard E. Smith
*Assistant Examiner*—Michael I. Kocharov
*Attorney, Agent, or Firm*—Wood, Phillips, Mason, Recktenwald & VanSanten

[57] ABSTRACT

Electric motor cooling difficulties in a ducted axial flow electric fan construction are avoided through the use of a duct-like housing (10) having an interior wall (30) with axially spaced feet (34), (40) within the housing (10) and radially inward of the interior wall (30). A motor stator (88) is located within the housing (10) and is engaged by the feet (34) and (40) to be mounted in spaced relation to the interior wall (30) with its exterior surface (98) between the feet (34), (40) and facing and exposed to the interior wall (30). A rotor (84) is journalled within the stator (88) and mounts an impeller (52) which drives ambient gas through the housing (10) in contact with the exterior surface (98) of the stator to cool the same.

6 Claims, 1 Drawing Sheet

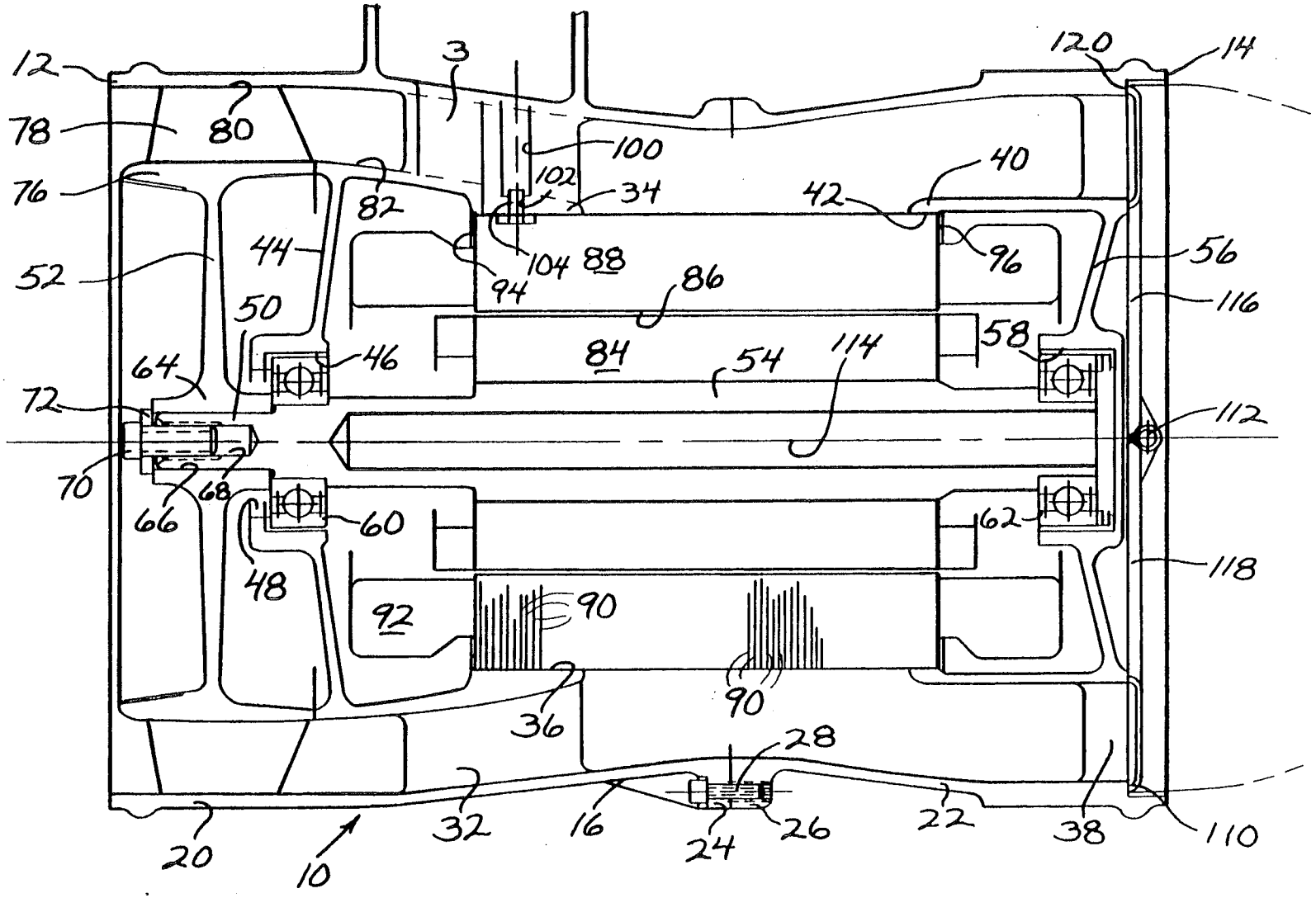
14
120
56
116
112
118
110
38
40
96
58
62
22
42
114
54
28
26
90
24
86
84
100
34
88
102
104
94
16
36
3
32
82
46
60
92
10
44
50
48
80
68
64
66
20
12
78
76
52
72
70

LOW WEIGHT FAN WITH INTERNAL COOLING

FIELD OF THE INVENTION

This invention relates to electric fan constructions, and more particularly, two electric fan constructions having duct-like housing.

BACKGROUND OF THE INVENTION

Electrically driven fans have been utilized extensively virtually since the invention of the electric motor itself. There are a large variety of types including radial flow fans, axial flow fans, centrifugal fans and the like. Each type of fan has various subtypes.

For example, axial flow fans may be generally categorized as being either ducted or unducted. An example of an unducted, axial flow fan is a common household cooling fan.

Ducted axial flow fans are provided with some sort of duct or housing that fits about the impeller closely adjacent the tips thereof so as to confine the air flow. Not untypically, in order to avoid complex gearing or the like, the impellers are mounted directly on the rotor shaft of an electrical motor in such ducted constructions which in turn means that the electric motor must be at least aligned with or even located internally of the ducting. Mounting of the motor may then become a problem as may the cooling thereof. The present invention is directed to overcoming one or more of the above problems.

SUMMARY OF THE INVENTION

It is the principal object of the invention to provide a new and improved electric fan, generally of the ducted, axial flow type. More specifically, it is an object of the invention to provide such a fan wherein the motor is easily and simply mounted and wherein adequate cooling of the motor is readily achieved.

An exemplary embodiment of the invention achieves the foregoing objects in an electric fan construction including a duct-like housing having an internal wall. Axially spaced first and second feet are located within the housing and radially inward of the interior wall. A motor stator is received within the housing and is engaged by the feet to be mounted in spaced relation to the interior wall. The stator has an exterior surface between the feet which is facing and exposed to the interior wall. A rotor is journalled for rotation about an axis within the stator and an impeller is mounted on the rotor and located within the housing and is operative upon rotation of the rotor to cause the ambient gas to pass through the space between the interior wall and the stator to contact the stator exterior surface in heat transfer relation therewith.

The use of the feet to mount the motor stator provides a simplified mounting scheme and which allows the exterior surface of the stator to be exposed to the path of gas through the duct-like housing to be cooled thereby.

In a preferred embodiment of the invention, the housing is formed of two sections with the first foot being in one section and the second foot being in the other section.

Preferably, the stator has opposed ends and the feet engage the stator at corresponding ends.

In one embodiment of the invention, the feet engage the exterior surface of the stator adjacent the opposed ends. In a highly preferred embodiment, the feet are defined by generally ring-like or cylindrical surfaces. The invention contemplates that the interior wall of the duct-like housing mount inwardly directed struts and that the feet be carried by corresponding ones of the struts.

In a highly preferred embodiment of the invention, the struts also include bearing mounting webs and bearings are mounted on such webs. The rotor is then journalled in such bearings. The invention also contemplates the provision of a pivot at one end of the housing and a valve seat generally aligned therewith. A valve member is mounted to the assembly by the pivot and is movable toward or away from the seat.

In a highly preferred embodiment, the pivot is located centrally of the valve seat and two valve members are pivoted thereto, one on each side of the pivot.

The invention also contemplates that the two part housing have a reduced diameter section intermediate its ends and that the two parts be defined by a circumferential split in the reduced diameter section. Fasteners to secure the two parts together are located on the exterior of the housing at the reduced diameter section and within the envelope defined by the ends of the housing to provide a compact structure.

Other objects and advantages will become apparent from the following specification taken in connection with the accompanying drawings.

DESCRIPTION OF THE DRAWINGS

The figure is a sectional view of an electric fan made according to the invention.

DESCRIPTION OF THE PREFERRED EMBODIMENT

An exemplary embodiment of an electric fan of a ducted, axial flow-type made according to the invention is illustrated in the drawing and with reference thereto is seen to include a housing, generally designated 10. The housing 10 includes opposed ends 12 and 14, both of which are open. The housing 10 has a generally circular cross section and intermediate the ends 12 and 14 is a reduced diameter section 16. At the reduced diameter section 16, there is a circumferential split 18 which divides the housing 10 into two parts 20 and 22.

Interengaging flanges 24 and 26 are located on respective sides of the split 18 on the housing parts 20 and 22 respectively.

At circumferentially spaced locations, only one of which is shown, threaded fasteners 28 secure the housing parts 20 and 22 together by interconnecting the flanges 24 and 26.

The housing 10 includes an interior surface 30 and the part 20 includes three or more radially inwardly extending struts 32. The struts, at a location inwardly of the interior wall 30 include a mounting foot 34 which is generally ring-like and has a cylindrical inner surface 36.

The housing part 22 also includes radially inwardly directed struts 38. The struts 38 also support within the interior of the housing 10 a mounting foot 40 which is ring-like and which has a cylindrical inner surface 42. It will be noted that the mounting feet 34 and 40 are axially spaced from one another within the housing.

Returning to the struts 30, the same also mount an inperforate web 44 which extends across the housing part 40 somewhat closer to the end 12 than to the circumferential split 18, and which include a bearing mounting recess 46 on one side thereof. Centrally of the web 44 is an opening 48 through which a stubshaft 50 extends to mount an impeller 52 within the end 12 of the housing part 20. The stubshaft 50 is part of a rotor shaft 54 as will be described in greater detail hereinafter.

The struts 38 likewise mount an imperforate web 56 which includes a bearing recess 58 facing the bearing recess 56. The web 56, however, lacks any opening corresponding to the opening 48, having an imperforate center 59.

Bearings 60 and 62 are received in the recesses 46 and 58 respectively and journal the rotor shaft 54 for rotation within the housing 10.

The impeller 52 includes a hub 64 which in turn is provided with a smooth interior bore 66 which receives the stub shaft 50, the latter also having a smooth exterior surface. That is to say, the interface of the hub 64 and the stub shaft 50 is smooth and free of keyways or the like. The stub shaft 50 includes an internal threaded bore 68 which receives a threaded fastener 70 whose head bears against a washer 72 which in turn engages the hub 64 to compressingly clamp the same against the inner race of the bearing 46. It will be observed that the components are sized so that the washer 72 does not engage the end of the stub shaft 50 so that the aforementioned compressive connection exits.

The impeller 52 terminates in a circumferential ring 76 mounting radially extending impeller vanes 78 which in turn terminate at ends 80 closely adjacent the inner wall 30 of the housing 10 and which may be of conventional form.

It will be observed that the ring 76 is aerodynamically contoured and is aligned with a smooth, generally cylindrical surface 82 which merges with the ring or foot 34 to minimize resistance to flow of ambient gas through the housing 10.

The shaft 54 supports a conventional electric motor rotor 84 within the central opening 86 of a stator 88. As can be seen, the stator 88 is made up of a stack of ferrous laminations 90 in a conventional fashion and includes windings, only the end turns 92 of which are shown. The stator 88 has opposite ends 94 and 96 which are received within the cylindrical openings 36 and 42 of the mounting feet 34 and 40. That is to say, the end most laminations 90 within the stack making up the stator iron are received within the feet 34 and 40, leaving the central outer surface 98 of the laminations 90 thereat exposed to and facing the interior surface 30 of the housing and in spaced relation thereto.

This, of course, occurs in the region of the reduced diameter section 16. The arrangement is such that from one end of the housing 10 to the other, the cross sectional area of the flow path through the housing remains constant even though the inner and outer diameter of such flow path changes. This is to assure that no undue resistance to the flow of gas occurs in the reduced diameter section 16.

The presence of the reduced diameter section 16 also enhances heat transfer. As will be readily apparent from the drawing, the air is moving axially, as well as radially inward, and thus will impinge to some degree on the central outer surface 98 of the laminations 90 to provide impingement cooling as well as conductive cooling. Heat transfer efficiency is thus enhanced by the presence of the reduced diameter section 16.

Desirably, one of the struts 32 may include a radial bore 100 terminating in a tapped, reduced diameter section 102 for receipt of a set screw 104 or the like in engagement with the stator 88 to prevent the same from moving within the mounting feet 34 and 40.

The housing part 22, and specifically, the end 14 therein includes concentric valve seats 110 and 111. In general alignment therewith, a pivot pin 112 extends across the end 14 to be mounted to the imperforate center 59 of the web 56 by any suitable means. That is to say, the pivot pin 112 is located centrally of the valve seats 110 and 111 and generally intersects the rotational axis 114 of the rotor 84.

First and second valve flaps 116 and 118 configured as half donuts are pivoted to the pivot pin 112 and include peripheral surfaces 120 and 121 configured to seat against the valve seats 110 and 111, respectively. The valve flaps 116 and 118 are shown in a closed position and a light spring (not shown) may be utilized to normally bias the valve flaps 116 and 118 to that position to provide a check valve action.

In operation, the impeller 52 will drive ambient gas as, for example, air into the housing 10 through the end 12 and drive it against the valve flaps 116 and 118 which will then open and allow the gas to be expelled through the end 14. In the process, the air will pass in direct heat exchange relation or contact with the outer surface 98 of the stator 88 to provide excellent cooling of the same.

It will also be appreciated that the use of the reduced diameter section 16 intermediate the ends 12 and 14 allows the housing parts 20 and 22 to be secured together by exterior fasteners without increasing the outer envelope of the overall structure. That is to say, the fasteners 28 are all located within the envelope defined by the ends 12 and 14.

The use of two housing parts 20 and 22 having a central circumferential split 18 allows easy assembly of the motor within the housing sections. Furthermore, it allows the housing 10 to be made up of two components to reduce the complexity of the castings required to form the housing.

The invention also allows a check valve function to be incorporated within the housing itself for compactness.

Significantly, a substantial weight reduction is achieved along with improved cooling by the elimination of any means on the electric motor part of the construction radially outward of the stator exterior surface 98, that is, by not providing a separate housing for the motor stator itself.

It will also be appreciated that this excellent cooling is achieved even though the motor itself is essentially sealed within the flow path for the gas save for the opening 48 within the web 44; but because the web 56 is completely imperforate, no pressure differential will exist that would allow the flow of gas into the motor through the opening 48 which could bring contaminants into its inner workings.

I claim:

1. An electric fan comprising:

an elongated duct-like housing having a generally circular cross section, opposed open ends, and a circumferential split between said ends dividing the housing into two parts;

means securing said parts together;

each of said parts having an internal ring of reduced diameter and inwardly directed, circumferentially spaced struts mounting the rings in aligned but axially spaced relation;

an electric motor stator located in said housing with its ends in corresponding ones of said rings;

bearing mounting webs on said struts;

bearings carried by said webs;

a rotor journalled in said stator by said bearings; and an impeller within said housing at one end thereof and secured to said rotor for rotation therewith.

2. The electric fan of claim 1 further including a pivot in said housing at the end opposite said impeller; a valve seat within said housing and aligned with said pivot; and at least one valve member mounted to said housing by said pivot and movable toward and away from said seat.

3. The electric fan of claim 2 wherein said pivot is located centrally of said valve seat and mounts two valve member, one on each side of said pivot.

4. An electric fan comprising:

an elongated duct-like housing having a generally circular cross section, opposed open ends, an intermediate reduced diameter section and a circumferential split in said reduced diameter section dividing the housing into two parts;

fasteners on the exterior of said housing at said reduced diameter section and generally within the envelope defined by said opposed ends and securing said parts together;

each of said parts having an internal ring of lesser diameter than said reduced diameter section and inwardly directed, circumferentially spaced struts mounting the rings in aligned but axially spaced relation;

an electric motor stator including electrical windings, and stacked ferrous laminations with an exterior surface sized to be received within said rings, said stator being located in said housing with end most laminations in said stack being located in corresponding ones of said rings;

bearing mounting webs on said struts;

bearings carried by said webs;

a rotor journalled in said stator by said bearings; and an impeller within said housing at one end thereof and secured to said rotor for rotation therewith.

5. The electric fan of claim 4 wherein said rotor includes a smooth cylindrical stub shaft at one end and said impeller includes a hub with a smooth base receiving said stub shaft, and a fastener threaded into said stub shaft and compressively loading said hub to secure said impeller to said rotor.

6. An electric fan comprising:

a duct-like housing having an interior wall;

axially spaced first and second feet within said housing and radially inward of said second wall, said feet being defined by generally cylindrical surfaces;

a motor stator within said housing and engaged by said feet to be mounted in spaced relation to said interior wall, said stator having an exterior surface between said feet facing and exposed to said interior wall;

a rotor journalled for rotation about an axis within said stator; and an impeller mounted on said rotor and located within said housing and operative upon rotation of said rotor to cause ambient gas to pass through the space between said interior wall and said stator and to contact said stator exterior surface in heat transfer relation therewith.

* * * * *